US006050231A

United States Patent [19]

Tisch et al.

[11] Patent Number: 6,050,231

[45] Date of Patent: Apr. 18, 2000

[54] METHOD FOR STARTING A MULTICYLINDER INTERNAL COMBUSTION ENGINE

[75] Inventors: Florian Tisch, Rechen-Ulm; Achim Koch, Tegernheim; Richard Wimmer, Parnkofen, all of Germany

[73] Assignee: Siemens Aktiengesellschaft, Munchin, Germany

[21] Appl. No.: 09/162,856

[22] Filed: Sep. 29, 1998

[51] Int. Cl.[7] ..... F02N 11/00

[52] U.S. Cl. ..... 123/179.1; 123/179.5

[58] Field of Search ..... 123/179.1, 179.5, 123/179.16, 179.18, 90.11

[56] References Cited

U.S. PATENT DOCUMENTS 4,009,695 3/1977 Ule ..... 123/90.13
4,462,348 7/1984 Giardini ..... 123/179.18
5,219,397 6/1993 Jones ..... 123/179.3

*Primary Examiner*—Tony M. Argenbright
*Assistant Examiner*—Arnold Castro
*Attorney, Agent, or Firm*—Herbert L. Lerner; Laurence A. Greenberg

[57] ABSTRACT

A method for starting a multicylinder internal combustion engine having electromechanically actuated inlet valves and outlet valves includes, during a starting operation, for at least one revolution of a crankshaft of the engine, operating the engine so that pistons of the cylinders, which are simultaneously at top dead center, perform in parallel an operating cycle including intake, compression, working, and expulsion, respective inlet valves of the cylinders being simultaneously opened and, after executing the intake and compression stroke, performing one operation selected from the group thereof consisting of ignition, fuel injection, and both ignition and fuel injection, simultaneously, and, after executing the working stroke, opening the outlet valves simultaneously for the expulsion.

3 Claims, 1 Drawing Sheet

METHOD FOR STARTING A MULTICYLINDER INTERNAL COMBUSTION ENGINE

BACKGROUND OF THE INVENTION

FIELD OF THE INVENTION

The invention relates to a method for starting a multicylinder internal combustion engine.

In a heretofore known manner, the working cycle of an internal combustion engine is made up of the work strokes of intake, compression, working and expulsion. On intake, the inlet valve is opened, while on expulsion the outlet valve is opened. In a multicylinder internal combustion engine with at least four cylinders, at least, respectively, two pistons at a time are simultaneously at top dead center, namely at the beginning of the intake stroke and at the beginning of the work stroke, respectively, in which the combustion takes place by ignition or fuel injection. The opening and closing of the inlet valves and outlet valves is effected either with a conventional camshaft controller or with solenoid valves triggered by an engine control unit.

From the published European Patent Document EP 0 367 443 A1, a valve controller for an internal combustion engine having inlet valves and outlet valves which are operated electromagnetically has become known heretofore. The valve controller turns one or more cylinders off in ongoing succession in the overrunning mode, by keeping both the inlet valve and the outlet valve closed, so that the cylinder compresses and expands without air or fuel being supplied.

The published German Patent Document DE 32 29 691 A1 describes a starter device for a multicylinder internal combustion engine which is intended to render superfluous a starter operated by an electric motor. In the underlying internal combustion engine, the valve control is effected mechanically. The inlet valves have an overpressure function, as a result of which, at a given overpressure in the cylinder, the inlet valves close even in the open state thereof. The outlet valves function conventionally. By means of a compressor driven by an electric motor and by means of the inlet valves with the overpressure function, when the stopped engine is started, ignition takes place simultaneously in two cylinders at a single time. The cylinders which are involved are specifically the cylinder that would be in the combustion stroke when the engine is running, and the cylinder having a piston that is in some setting of the intake stroke. In the latter cylinder, compressed air is passed through the opened inlet valve and fuel is injected, and this air and fuel mixture which is at overpressure is ignited. This causes a further pressure rise in this cylinder, the inlet valve of which is open. Because of the increased overpressure, the inlet valve closes due to the overpressure function thereof, and the piston of this cylinder follows along with the expansion motion. The other cylinder in which ignition occurs is in a setting of the combustion stroke and, therefore, the valves thereof are closed, and ignition can occur in a conventional manner. A result thereof is that an internal combustion engine is set into motion without a starter operated by an electric motor. Thereafter, engine operation takes place in the normal ignition order and the normal order of working strokes, respectively, which, because of the conventional outlet valves with mechanical control cannot, in any event, be otherwise possible.

SUMMARY OF THE INVENTION

It is thus an object of the invention to provide an improved method for starting a multicylinder internal combustion engine in which, for the starting operation, a rapid buildup of torque and a pronounced rpm gradient are attained.

With the foregoing and other objects in view, there is provided, in accordance with the invention, a method for starting a multicylinder internal combustion engine having electromechanically actuated inlet valves and outlet valves, which comprises, during a starting operation, for at least one revolution of a crankshaft of the engine, operating the engine so that pistons of the cylinders, which are simultaneously at top dead center, perform in parallel an operating cycle including intake, compression, working, and expulsion, respective inlet valves of the cylinders being simultaneously opened and, after executing the intake and compression stroke, performing one operation selected from the group thereof consisting of ignition, fuel injection, and both ignition and fuel injection, simultaneously, and, after executing the working stroke, opening the outlet valves simultaneously for the expulsion.

In accordance with another mode, the method according to the invention includes terminating the respective simultaneous actuation of the inlet valves and the outlet valves, respectively, when a predetermined rpm is reached.

In accordance with a concomitant and alternative mode, the method according to the invention includes terminating the respective simultaneous actuation of the inlet valves and the outlet valves, respectively, after a predetermined number of working cycles.

In contrast with the conventional camshaft control, with which the working cycle is possible only in a serial manner, i.e., the cylinders can output a torque only in accordance with the ignition sequence of the engine, in an internal combustion engine with electromechanically actuated inlet valves and outlet valves, a starting operation can be performed in which the inlet valves of the cylinders which have pistons simultaneously at top dead center are opened, so that these cylinders aspirate, compress, and perform the working stroke in parallel.

This increases the torque in the starting operation. A faster torque buildup and thus a greater rpm gradient are the consequence. According to the invention, a shorter starting period, a greater starting reliability, or also a reduction in the required size of the starter and the energy supply are thus attained.

Other features which are considered as characteristic for the invention are set forth in the appended claims.

Although the invention is illustrated and described herein as a method for starting a multicylinder internal combustion engine, it is nevertheless not intended to be limited to the details shown, since various modifications may be made therein without departing from the spirit of the invention and within the scope and range of equivalents of the claims.

The method of operation of the invention, however, together with additional objects and advantages thereof will be best understood from the following description of specific embodiments of equipment for performing the method when read in connection with the accompanying drawings, wherein:

DESCRIPTION OF THE PREFERRED EMBODIMENTS

Figure 1:
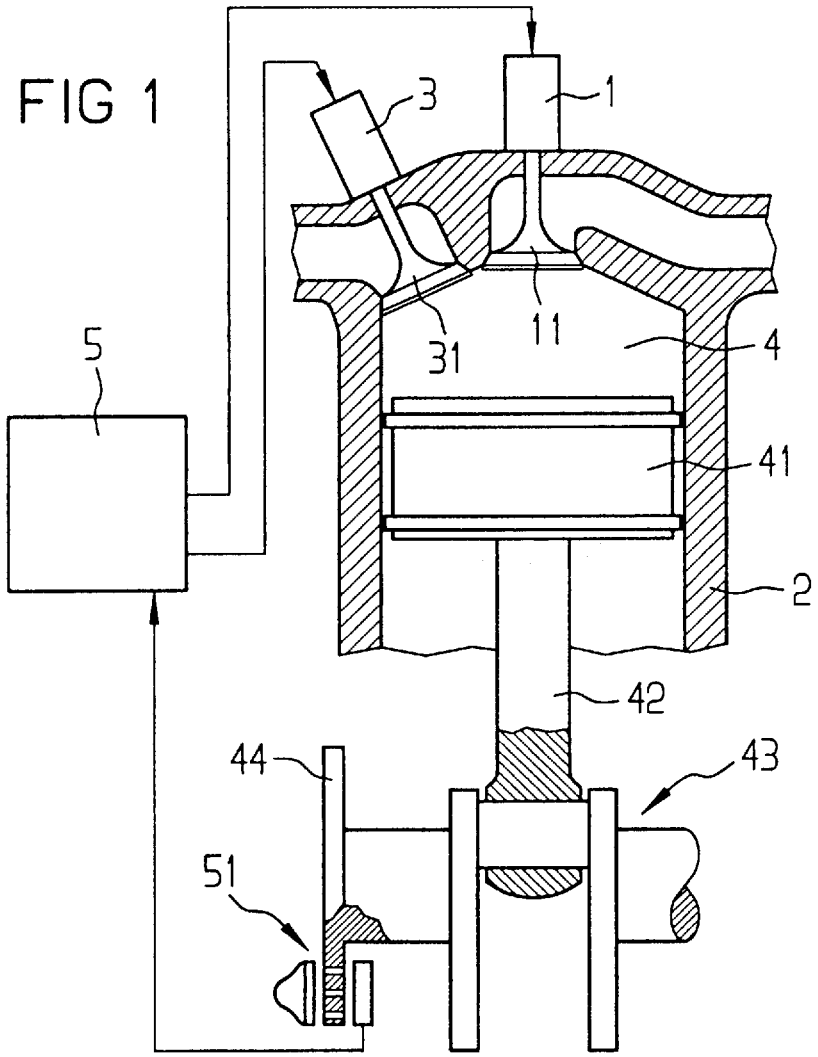
FIG. 1 is a schematic and diagrammatic view, partly in section, of a cylinder with an electrically actuated inlet valve and outlet valve.

Referring now to the drawing and, first, particularly to FIG. 1 thereof, there is shown therein an internal combustion engine having an electromechanical valve drive. Both an outlet valve 11 and an inlet valve 31 are operated by electromagnetic actuators 1 and 3 which are conventionally triggerable by an engine control unit 5. The piston 41 moves within a cylinder II (note FIG. 2) and is connected via a connecting rod 42 to a crankshaft 43. At a crankshaft star 44, the crankshaft position is ascertained by a crankshaft transducer 51 and that information is suitably fed to the engine control unit 5. In a multicylinder engine, there are naturally more than one cylinder II.

Figure 2:
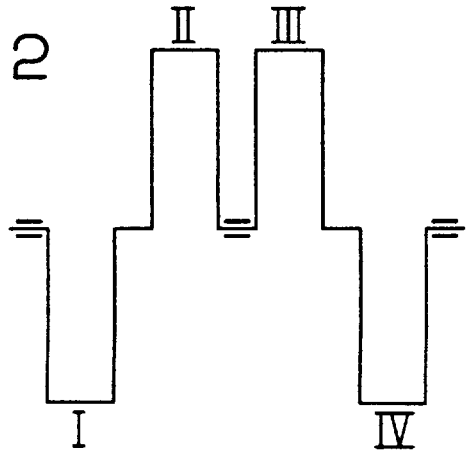
FIG. 2 is a diagrammatic illustration of the cylinder arrangement for a four-cylinder engine.

FIG. 2 diagrammatically shows the crankshaft structure for a four-cylinder engine. The non-illustrated pistons of cylinders I and IV are located at bottom dead center, and the non-illustrated pistons of cylinders II and III are at top dead center. At the cylinders II and III, the inlet valves are opened and the outlet valves are closed. Both cylinders II and III are capable of performing the intake stroke simultaneously. After the compression, ignition takes place in both cylinders II and III at approximately the top dead center position of the pistons. After the working stroke, both outlet valves of the cylinders II and III are opened and expulsion follows. The same applies appropriately for cylinders I and IV.

According to the invention, the torque in the starting operation is thus increased considerably, thereby shortening the starting time, reducing the size of the starter required, and requiring less energy which would otherwise have to be drawn from a battery. This parallel starting mode is performed upon the first revolutions of the engine, after which the triggering of the electromagnetically actuated valves is effected in a conventional manner.

Alternatively, the parallel starting mode of operation is performed until the crankshaft has reached a predetermined rpm.

The method described for a four-cylinder engine is naturally possible for six, eight or twelve cylinders, as well; in each case, the pistons of the cylinders which are simultaneously at top dead center are always combined for parallel execution of a working cycle.

We claim:

1. A method for starting a multicylinder internal combustion engine having electromechanically actuated inlet valves and outlet valves, which comprises, during a starting operation, for at least one revolution of a crankshaft of the engine, operating the engine so that pistons of the cylinders, which are simultaneously at top dead center, perform in parallel an operating cycle including intake, compression, working, and expulsion, respective inlet valves of the cylinders being simultaneously opened and, after executing the intake and compression stroke, performing one operation selected from the group thereof consisting of ignition, fuel injection, and both ignition and fuel injection, simultaneously, and, after executing the working stroke, opening the outlet valves simultaneously for the expulsion.

2. The method according to claim 1, which includes terminating the respective simultaneous actuation of the inlet valves and the outlet valves, respectively, when a predetermined rpm is reached.

3. The method according to claim 1, which includes terminating the respective simultaneous actuation of the inlet valves and the outlet valves, respectively, after a predetermined number of working cycles.

* * * * *